United States Patent [19]

Raiche

[11] Patent Number: 4,479,449

[45] Date of Patent: Oct. 30, 1984

[54] DIFFERENTIAL FEED TYPE SEWING MACHINE

[76] Inventor: Réjean Raiche, 628-43rd Ave., La Salle, Canada, H8P 3B7

[21] Appl. No.: 484,912

[22] Filed: Apr. 14, 1983

[51] Int. Cl.[3] ..... D05B 35/08

[52] U.S. Cl. ..... 112/312; 112/152; 112/305

[58] Field of Search ..... 112/312, 311, 121.27, 112/152, 151, 305

[56] References Cited

U.S. PATENT DOCUMENTS

| | | | |
|---|---|---|---|
| 2,125,459 | 8/1938 | Pitts . | |
| 2,689,538 | 9/1954 | Rickman | 112/312 |
| 2,723,636 | 11/1955 | Galkin | 112/152 X |
| 2,744,481 | 5/1956 | Blittschan | 112/152 X |
| 3,371,630 | 3/1968 | Cash, Jr. | 112/305 X |
| 4,063,524 | 12/1977 | Ochiai . | |
| 4,377,122 | 3/1983 | Boser et al. | 112/305 X |

FOREIGN PATENT DOCUMENTS 369170 10/1937 Canada .

*Primary Examiner*—Werner H. Schroeder
*Assistant Examiner*—Andrew M. Falik

[57] ABSTRACT

A sewing machine of the differential type which, in one stitching operation, gathers a first fabric material and sews a band to one side of said first fabric material and a second fabric material to the other side of the first fabric material. The throat plate of the sewing machine has a longitudinal groove disposed ahead of the sewing needle to guide the band underneath the fabric material being gathered by the gathering dog. No gathering dog is in register with the groove. The machine may include overlock stitching.

7 Claims, 6 Drawing Figures

DIFFERENTIAL FEED TYPE SEWING MACHINE

BACKGROUND OF THE INVENTION

This invention relates to sewing machines, and in particular to a sewing machine of the differential feed type produces gathering of a first fabric material, upon stitching thereof to a second fabric material or the like as done for instance on an overlock machine.

DESCRIPTION OF THE PRIOR ART

At the present time, two separate stitching operations are required to gather the waist of a skirt, sleeve, or the like, and to assemble it to a corsage, with an elastic band applied directly to the skirt. This is cumbersome and inefficient.

SUMMARY OF THE INVENTION

It is therefore an object of the invention to overcome the previously-noted disadvantage by combining the process in a single sewing operation. In accordance with the invention briefly stated, a longitudinally-grooved throat plate on the bed of a sewing machine is provided with a first feed dog, and a second feed dog, to produce differential feeding of a first fabric material such as a skirt relative to an elastic band and a second fabric material such as a corsage. The elastic band passes under the skirt, within a groove in the throat plate, and between two claw sections of the first feed dog. This way, the elastic band is not gathered with the skirt. The corsage is kept out of reach of those claw sections by a guide device above the throat plate.

DETAILED DESCRIPTION OF THE PREFERRED EMBODIMENT OF THE INVENTION

For the purpose of describing the invention, there is shown in the accompanying drawings a sewing machine of standard make, designated by the numeral 10, and having a pair of needles movable up and down. However, it is to be understood that the present invention is also applicable to sewing machines of the type which produces a straight line of stitching.

Figure 1:
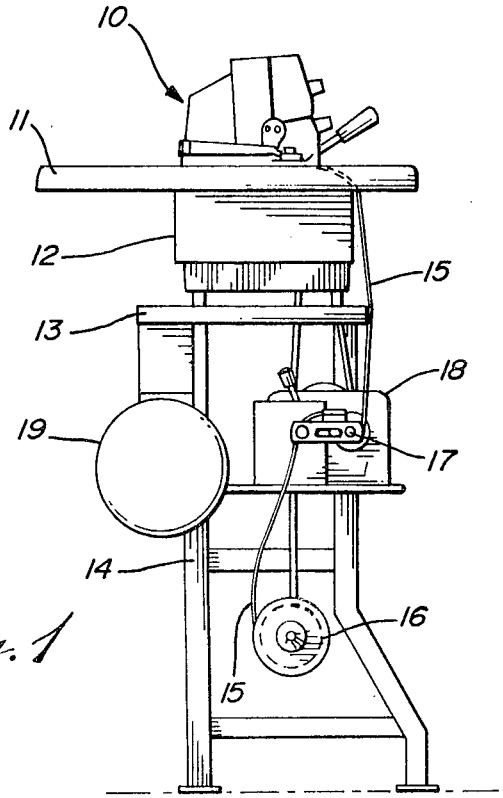
FIG. 1 is a side elevational view of a sewing machine mounted on a table and constructed according to the present invention.

The sewing machine 10 of FIG. 1 comprises a base plate 11 and a casing 12. The sewing machine is preferably mounted over a table or work bench 13, the latter being supported by upright frame 14. Elastic band 15 is stored in a real 16, and feeds sewing machine 10 through a tension regulating device 17 around which band 15 is looped, device 17 being of known construction and driven by a drive block 18. The reel 16 is illustrated to be at a lower level than the drive block 18, but this is by no means the only arrangement possible in this invention. A motor or power block 19 for sewing machine 10 also drives the drive block 18.

Figure 2:
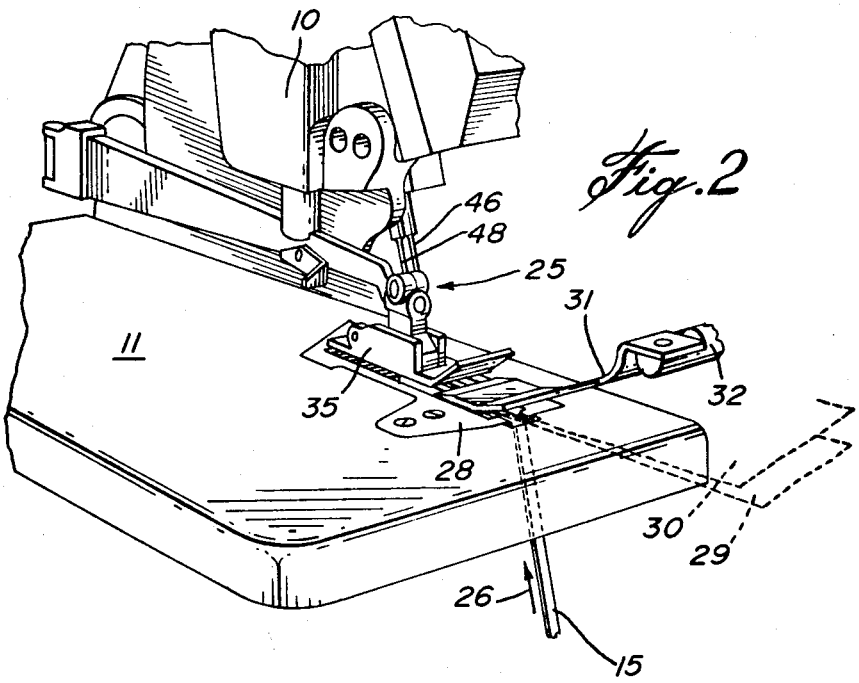
FIG. 2 is a perspective view showing details at the needle station of the machine of FIG. 1.
Figure 3:
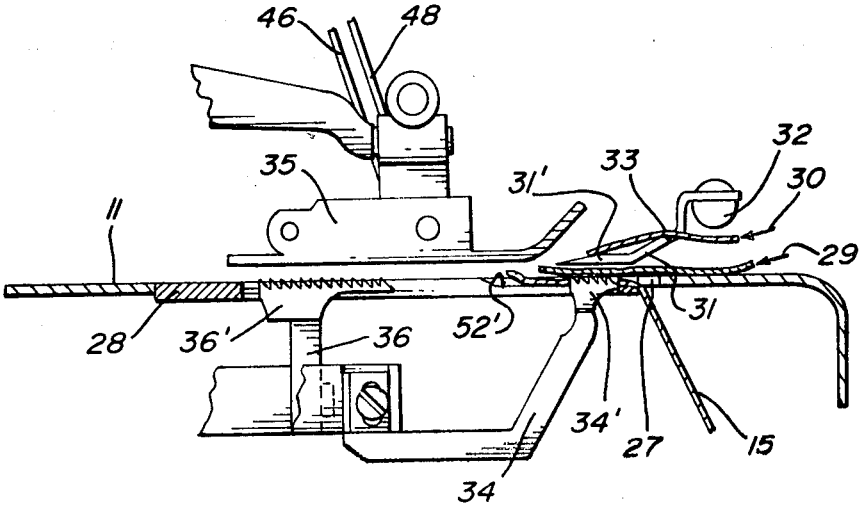
FIG. 3 is a fragmentary longitudinal sectional view showing details from FIG. 2.
Figure 4:
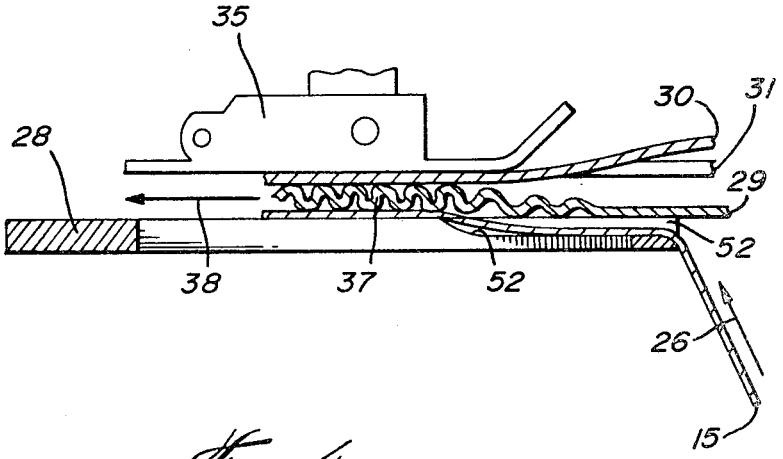
FIG. 4 is an enlarged longitudinal sectional view taken longitudinally of the pressure foot and the throat plate shown in FIG. 3, the view showing the process of gathering a skirt, assembling it to a corsage, and putting an elastic band to the skirt to form a dress.

Referring now to FIGS. 2 to 4, a double-needle stitching mechanism 25 is shown overlying base plate 11. The band 15 feeds machine 10 along direction 26 upward through base plate 11, through an opening 27 immediately forwardly of throat plate 28. A first fabric material, such as a skirt 29, and a second fabric material such as a corsage 30, join with the elastic band 15 to be sewn together. The the edge of skirt 29 is sewn to the edge of corsage 30 preferably by an overlock stitch, while the elastic band, 15 is sewn to the skirt 29 and corsage 30 preferably by a chain stitch.

A guide device, such as metal guide strip 31, projects forwardly from base plate 11, and is held by a rod 32 at an angle relative to the base plate 11. The strip 31 has a portion 31' parallel to and spaced above throat plate 28 in front of presser foot 35. Strip 31 a step 33 in its intermediate portion, over which the corsage 30 engages. A first feed dog 34 has claws 34' which will selectively grip the skirt 29, whereas the guide strip 31 will keep the corsage 30 out of reach by the claws of first feed dog 34. The three pieces of fabric will nevertheless slide over needle or throat plate 28 (to be described later), under presser foot 35, to be sewn together. A second feed dog 36 controls the speed at which the pieces of fabric are sewn together, and dragged away by claws 36' of dog 36 in the direction 38. The claws 34' of the first feed dog move at a higher speed than the rear claws 36' formed by the second feed dog.

The sewing machine machanism may now be readily understood. When skirt 29 is gripped by feed dog 34 against backing portion 31', it is fed faster than the corsage 30 and the band 15. The skirt 29 therefore becomes gathered, as generally indicated by 37. An essential characteristic of our invention is therefore that this differential speed of feeding the skirt 29 relative to the corsage must not affect the sewing of the elastic band 15 which must not be gathered.

Figure 6:
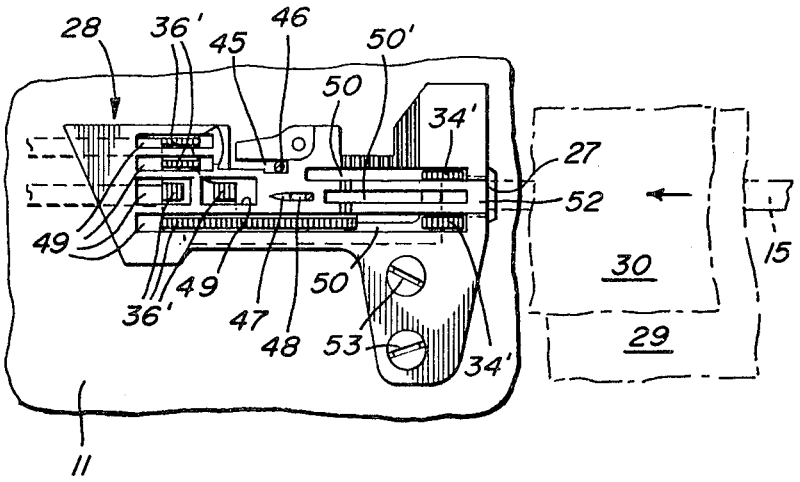
FIG. 6 is a top plan view of the mechanism shown in FIG. 5, in operative position a cut-away portion of the table of a sewing machine.
Figure 5:
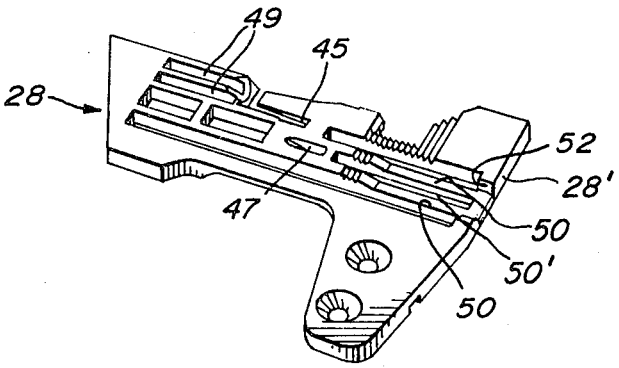
FIG. 5 is a perspective view of a throat plate for the overlock and chain stitch mechanism of an overlock sewing machine.

FIGS. 5 and 6 show the conventional throat plate 28, of general T-shape and modified by the provision of front groove in accordance with the invention. Numerous longitudinal slots are embodied within throat plate 28, including: a first slot 45, opening up laterally outward, and intended to receive the engaging overlock needle 46 (see also FIG. 2); a second opening 47, centrally located on the throat plate, and into which engages chain stitch needle 48; rear slots 49 for claws 36', and front slots 50 for claws 34'. A groove 52 extends longitudinally in the front half of throat plate 28 from the forward edge 28' thereof, in alignment with chain stitch needle opening 47 and terminating short of the latter. Groove 52 positively guides the band 15 to the chain stitch needle 48 without affecting the gathering operation on skirt 29. Bolts 53 tightly connect throat plate 35 to base plate 11. The groove 52 has a width just sufficient to guide band 15 and its bottom face 52' defines a sufficient thickness for the band to move below the top of throat plate 28.

As can be seen, the first feed dog 34 has only two claws 34', which move laterally outwardly of groove 52. The central claw moving in central slot 50' has been eliminated. This slot 50' has therefore no purpose in the present invention and could be eliminated. The arrangement allows the band 15 to pass under skirt 29 in aperture 27 without being engaged by the gathering forward claws 34' and, therefore, without becoming gathered.

In one operation, the machine does what previously took two distinct operations: it gathers the skirt, stitches an elastic band to the gathered skirt and to the flat cordage; it can also perform an overlock stitch. It is to be understood that any gathering sewing machine may be used for the purpose of our invention, although the improvement as shown is embodied in an overlock sewing machine with gathering mechanism.

The present invention permits to obtain the desired and uniform tensioning of the elastic band and always the same skirt gathering, therefore ensuring a constantly-uniform commercial product.

The invention can be applied to other pieces of fabric than a corsage and a skirt.

What I claim is:

1. A sewing machine of the differential feed type, comprising at least one sewing needle; a throat plate having a top face and a forward edge and defining one needle opening underlying said needle, a first slot in the throat plate extending in a sewing direction forwardly and laterally outward of said needle opening, a second slot in the throat plate extending in the sewing direction rearwardly of and in alignment with said needle opening, and a groove in the throat plate opening at said top face and having a bottom face, said groove extending stripwise from said forward edge towards said needle opening and in alignment with the latter in the sewing direction; gathering dogs and feeding dogs reciprocatively displaceable in the sewing direction and including a forward claw and a rearward claw, respectively, with the forward claw movable faster than the rearward claw, and both upwardly projecting through said first and second slots respectively, said groove defining a path for a band fed to said sewing needle, said forward claw being laterally outward of said path, said forward claw gripping one fabric material and moving it at a higher speed on the throat plate relative to said band and to another fabric material overlying said one fabric material, both fabric materials and said band being sewn together by said sewing needle with said one fabric material in gathered condition and both said fabric materials and said band being moved by said rearward claw.

2. A sewing machine as defined in claim 1, wherein there is a pair of said first slots provided laterally outward on each side of said groove, and there are additional second slots provided laterally outward on each side of the first-named second slot, there being as many corresponding forward claws and rearward claws, each upwardly projecting in a respective slot, said groove being of a width to accommodate and guide said band and of a depth sufficient to prevent said band from protruding from said top face of said throat plate.

3. A sewing machine as claimed in claim 2, wherein said band constitutes an elastic band and a tensioner device is mounted below the throat plate and constructed and arranged for tensioning of the elastic band during sewing thereof to the fabric materials.

4. A sewing machine as defined in claim 1 wherein said band constitutes an elastic band and a tensioner device is mounted below the throat plate and constructed and arranged for tensioning of the elastic band during sewing thereof to the fabric materials.

5. A sewing machine as defined in claim 1, further including a guiding device operatively mounted above the throat plate forwardly of said sewing needle opening and in register with said first slot and forward claw and having a rearward portion substantially parallel to said throat plate and rearwardly terminating short of said needle opening, said guiding device guiding said another fabric material thereover out of reach of said forward claw.

6. A sewing machine as defined in claim 5, wherein said band constitutes an elastic band and a tensioner device is mounted below the throat plate and constructed and arranged for tensioning of the elastic band during sewing thereof to the fabric materials.

7. A sewing machine as defined in claim 5, wherein said groove opens at said forward edge and terminates rearwardly short of said needle opening.

* * * * *